United States Patent [19]

Kawakami et al.

[11] 4,169,076

[45] Sep. 25, 1979

[54] PROCESS FOR PRODUCING CLEAR AQUEOUS SOLUTION OF MAGNESIUM SALT OF ANIONIC SURFACE ACTIVE AGENT

[75] Inventors: Akira Kawakami, Sakura; Yoshio Aoki, Tokyo; Toshiaki Ogoshi, Funabashi, all of Japan

[73] Assignee: The Lion Fat and Oil Co., Ltd., Tokyo, Japan

[21] Appl. No.: 906,430

[22] Filed: May 16, 1978

[30] Foreign Application Priority Data

May 31, 1977 [JP] Japan ..... 52-63514

[51] Int. Cl.[2] ..... C11D 1/12

[52] U.S. Cl. ..... 252/558; 252/550; 252/553; 252/554; 252/555

[58] Field of Search ..... 252/558, 554, 550, 553, 252/555

[56] References Cited

U.S. PATENT DOCUMENTS

| | | | |
|---|---|---|---|
| 2,241,790 | 5/1941 | Rembert | 252/553 |
| 3,869,399 | 3/1975 | Collins | 252/559 |
| 3,898,187 | 8/1975 | Miller | 252/553 |
| 3,998,750 | 12/1976 | Payne et al. | 252/559 |

*Primary Examiner*—Mayer Weinblatt

*Attorney, Agent, or Firm*—Armstrong, Nikaido, Marmelstein & Kubovcik

[57] ABSTRACT

Disclosed is a process for producing a clear aqueous solution of the magnesium salt of an anionic surface active agent by first adding alkylbenzene sulfonic acid to an aqueous slurry containing an anionic surface active agent and an alkaline agent in a specified amount and, then, adding a pH controlling agent to the resultant solution.

3 Claims, No Drawings

PROCESS FOR PRODUCING CLEAR AQUEOUS SOLUTION OF MAGNESIUM SALT OF ANIONIC SURFACE ACTIVE AGENT

BACKGROUND OF THE INVENTION

1. Field of the Invention

The present invention relates to a process for producing a clear aqueous solution of the magnesium salt of a sulfonic acid type or sulfuric ester type anionic surface active agent. More specifically, it relates to a process for producing a clear or transparent aqueous solution of an anionic surface active agent containing a substantial amount of only slightly water-soluble magnesium salt of alkylbenzene sulfonic acid.

2. Description of the Prior Art

Sulfonic acid type or sulfuric ester type anionic surface active agents have heretobefore been used usually in the form of a sodium salt. However, recently, magnesium salt type anionic surface active agents have become of major interest as an active agent for a detergent having an excellent frothing property.

Generally known methods for producing a sulfonic acid type or sulfuric ester type anionic surface active agent in the form of a magnesium salt are a metathesis or double-decomposition process in which the sodium salt of said anionic surface active agent is reacted with, for example, magnesium chloride and a neutralizing process in which sulfonic acids or sulfuric esters are directly neutrlized with magnesium hydroxide or magnesium oxide. Of these known processes, the former process has a disadvantage that large quantities of inorganic salts are necessarily produced as by-products and must be removed from the product, although the metathesis reaction easily occurs. On the other hand, the latter process has an advantage that such by-product is not formed. However, this process has the disadvantages that, since magnesium oxide or magnesium hydroxide to be used as a neutralizing agent is only slightly soluble in water, a long neutralization operation is required and that a clear neutralization solution cannot be obtained within a generally acceptable time period. Especially, when alkylbenzene sulfonic acid is directly neutralized with magnesium hydroxide, there is only a small chance of obtaining a clear aqueous solution of magnesium alkylbenzene sulfonate.

SUMMARY OF THE INVENTION

The objects of the present invention are to obviate the above-mentioned disadvantages of the conventional process for producing the magnesium salt solution in water of alkylbenzene sulfonic acid and to provide a process for producing a clear aqueous solution of the magnesium salt of an anionic surface active agent containing a substantial amount of magnesium alkylbenzene sulfonate.

Other objects and advantages of the present invention will be apparent from the description set forth hereinbelow.

In accordance with the present invention, there is provided a process for producing a clear aqueous solution of the magnesium salt of an anionic surface active agent comprising the steps of:

(a) adding alkylbenzene sulfonic acid to an aqueous slurry containing the water-soluble salt of a sulfonic acid type or sulfuric ester type anionic surface active agent and at least one alkaline agent selected from the group consisting of magnesium hydroxide and magnesium oxide, to thereby prepare a clear aqueous solution having a pH of from approximately 2 to approximately 4, the amount of said alkylbenzene sulfonic acid being such that (i) said amount is enough in stoichiometrical excess to said alkaline agent in the slurry to adjust the pH of the resultant clear aqueous solution within the range of from approximately 2 to approximately 4 and (ii) the weight ratio of the water-soluble salt of the anionic surface active agent in the slurry to the alkylbenzene sulfonic acid is within the range of from 20/80 to 95/5, and then;

(b) adding at least one pH controlling agnet selected from the group consisting of alkali hydroxides, ammonia and alkanolamines to the aqueous solution, to thereby control the pH of the resultant solution within the range of from approximately 5.5 to approximately 8.

DESCRIPTION OF THE PREFERRED EMBODIMENTS

According to the first step of the present invention, alkylbenzene sulfonic acid is added, in the specified amount, to an aqueous slurry containing the water-soluble salt of a sulfonic acid type or sulfuric ester type anionic surface active agent and the above-mentioned alkaline agent. Thus, a clear aqueous solution having a pH of approximately 2 to approximately 4 is first obtained.

The water-soluble salt of the sulfonic acid type or sulfuric ester type anionic surface active agent to be contained in the slurry can be, for example, the sodium salt and magnesium salt of olefin sulfonic acids of 8 to 22 carbon atoms, such as the sodium and magnesium salts of Δ'-dodecene sulfonic acid, Δ'-tetradecene sulfonic acid, Δ'-hexadecene sulfonic acid, Δ'-octadecene sulfonic acid and their position isomers having a double bond in the different site and mixtures thereof; the sodium salt of alkylbenzene sulfonic acids of 10 to 15 carbon atoms, such as the sodium salt of decylbenzene sulfonic acids, undecylbenzene sulfonic acids, dodecylbenzene sulfonic acids, tridecylbenzene sulfonic acids, tetrabenzene sulfonic acids and mixtures thereof; the sodium salt and the magnesium salt of alkyl sulfuric esters having alkyl radicals of 8 to 22 carbon atoms, such as the sodium and magnesium salts of decyl sulfate, dodecyl sulfate (lauryl sulfate), tetradecyl sulfate (myristyl sulfate), hexadecyl sulfate, octadecyl sulfate and mixtures thereof, and; the sodium salt and the magnesium salt of alkyl ether sulfuric esters having an alkyl radicals of 8 to 22 carbon atoms and having an average addition mole number ($\bar{p}$) of alkylene oxide of 1 to 10, such as the sodium and magnesium salts of decyl triethoxy sulfate ($\bar{p}=3$), dodecyl monoethoxy sulfate ($\bar{p}=1$), dodecyl diethoxy sulfate ($\bar{p}=2$), dodecyl triethoxy sulfate ($\bar{p}=3$), dodecyl tetraethoxy sulfate ($\bar{p}=4$), tetradecyl monoethoxy sulfate ($\bar{p}=1$), tetradecyl diethoxy sulfate ($\bar{p}=2$), tetradecyl triethoxy sulfate ($\bar{p}=3$), tetradecyl tetraethoxy sulfate ($\bar{p}=4$) and mixtures thereof.

The concentration or solid contents of the slurry used may be varied from the desired content of the surface active agent in the clear aqueous solution produced according to the present invention, as will be apparent to those skilled in the art. Preferably, the addition amounts of the alkylbenzene sulfonic acid and the pH controlling agent are respectively selected so as to produce a clear aqueous solution of the anionic surface active agent having a concentration of the surface active agent of approximately 10 to approximately 30% by weight.

The alkylbenzene sulfonic acid to be added to the above-mentioned slurry can be prepared by sulfonating alkylbenzene in any known procedure. Typical examples of such alkylbenzene sulfonic acids are decylbenzene sulfonic acids, undecylbenzene sulfonic acids, dodecylbenzene sulfonic acids, tridecylbenzene sulfonic acids, tetrabenzene sulfonic acids and mixtures thereof.

The addition amount of the alkylbenzene sulfonic acid must satisfys both the requirements (i) and (ii) mentioned above. That is to say, the first requirement is that the amount of the alkylbenzene sulfonic acid to be added to the slurry must be enough in stoichiometrical excess to said alkaline agent present in the slurry to adjust the pH of the resultant clear aqueous solution within the range of from approximately 2 to approximately 4. The preferable amount of the alkylbenzene sulfonic acid is within the range of from 1.03 to 1.1 chemical equivalent, based on one chemical equivalent of said alkaline agent present in the slurry, whereby the pH of the resultant clear aqueous solution can be maintained within the range of from approximately 2 to approximately 4.

The second requirement is that the weight ratio of the water-soluble salt of the anionic surface active agent present in the slurry to the alkylbenzene sulfonic acid to be added to the slurry (i.e. the water-soluble salt/the sulfonic acid) must be within the range of from 20/80 to 95/5, more preferably, from 20/80 to 80/20. When the addition amount of the alkylbenzene sulfonic acid is more than the above-mentioned upper limit, the produced magnesium salt of the alkylbenzene sulfonic acid cannot be solubilized. Contrary to this, when the addition amount of the alkylbenzene sulfonic acid is less than the above-mentioned lower limit, it becomes difficult to maintain the pH of the resultant clear aqueous solution within the range of from approximately 2 to approximately 4, even if the first requirement (i) is fulfilled.

In addition, when the pH of the clear aqueous solution obtained after the addition of the alkylbenzene sulfonic acid to the slurry is less than 2, unfavourable problems, such as foreign odor, discoloration and the like unpreferably occur due to the deterioration of the surface active agent present in the solution. On the other hand, when the pH of the clear aqueous solution obtained from the first step of the present invention is more than 4, white precipitates are liable to be generated in the solution. According to the second step of the present invention, to the clear aqueous solution obtained in the first step of the present invention, which has a pH of approximately 2 to approximately 4, the pH controlling agent selected from alkalihydroxides, ammonia and alkanolamines is then added. Suitable examples of the alkali hydroxides are sodium hydroxide and potassium hydroxide and a suitable example of alkanolamines is triethanol amine.

The pH controlling agent to be employed in the second step of the present invention functions as a neutralizing agent for free alkylbenzene sulfonic acid present in the clear aqueous solution having a pH of 2 to 4. The pH controlling agent is added in such an amount that the pH of the neutralized solution is within the range of from approximately 5.5 to approximately 8. When the pH of the solution after the addition of the controlling agent is more than 8, white precipitates of magnesium hydroxide are generated in the solution, whereby the resultant solution unpreferably becomes opaque. Contrary to this, when the pH of the solution after the addition of the controlling agent is less than approximately 5.5, free acid is unpreferably liable to be remained in the solution. In this connection when the sulfonic acid type or sulfuric ester type surface active agent is neutralized in the form of the magnesium salt, the pH of the solution is around 5 through 7. Thus, according to the second step of the present invention, the desired clear aqueous solution of the magnesium salt of the anionic surface active agent, having a pH of approximately 5.5 to approximately 8, is produced by adding the controlling agent to the clear aqueous solution having a pH of approximately 2 to approximately 4, which is obtained from the first step of the present invention. The amounts of the controlling agent used can be selected from the amount just sufficient to make a pH of the solution within the range of from approximately 5.5 to approximately 8, as will be apparent to those skilled in the art.

As is clear from the above description, according to the present invention, a clear and uniform aqueous solution of the magnesium salt of the sulfonic acid type or sulfuric ester type surface active agent can be produced. The aqueous solution produced by the present invention has, therefore, an advantage that it can be directly utilized in, for example, the production of a detergent (or a cleaning agent), without any further separation operation (e.g. centrifugation, precision filtration) of magnesium hydroxide. The first and second steps of the present invention can be carried out, generally at a temperature of 20° to 70° C., and preferably at a temperature of 30° to 60° C., although these temperature ranges by no means limit the present invention.

The present invention now will be further illustrated by the following examples. However, it should be understood that these are presented merely to explain and not to limit the invention, and that numerous changes may be made without departing from the spirit and the scope of the invention as hereinafter claimed.

Examples 1 to 23

An aqueous slurry containing the sodium or magnesium salt of the anionic surface active agent and the alkali agent listed in Table 1, below, was charged into a 1000 ml beaker, and then, the amount, listed in Table 1, of linear alkylbenzene sulfonic acid (LAS), having a molecular weight of 323, was added thereto. The pH of the resultant solution (or dispersion) after the completion of the acid addition is shown in Table 1.

To the solution thus obtained, the pH controlling agent listed in Table 1 was added, to thereby produce the aqueous solution (or dispersion) having a pH shown in Table 1.

The results are shown in Table 1.

Table 1

| Example No. | Slurry: Water-soluble salt of surface active agent *1 Compound | *2 M.W. | Weight (g) | Alkaline agent Compound | Weight (g) | Water (g) | *3 LAS (g) | pH after LAS addition | Controlling agent | pH of product | *4 AI Conc. (%) | Precipitation 40° C. |
|---|---|---|---|---|---|---|---|---|---|---|---|---|
| 1 *5 | AOS-Mg | 305 | 20 | $Mg(OH)_2$ | 16.7 | 550 | 180 | 3 | NaOH | 6.5 | 25 | yes |
| 2 *5 | " | 305 | 100 | " | 9.5 | 550 | 100 | 5 | " | 6.5 | 25 | yes |
| 3 | " | 305 | 100 | " | 9.4 | 350 | 100 | 3.5 | " | 6.5 | 35 | no |
| 4 *5 | AOS-Na | 317 | 100 | " | 9.6 | 350 | 100 | 5.5 | KOH | 5.5 | 35 | yes |
| 5 | " | 317 | 100 | " | 9.3 | 350 | 100 | 3 | " | 5.5 | 35 | no |
| 6 | AS-Mg | 277 | 20 | $Mg(OH)_2$ | 16.7 | 550 | 180 | 3 | $NH_4OH$ | 6.5 | 25 | yes |
| 7 *5 | " | 277 | 100 | " | 9.6 | 550 | 100 | 6 | " | 6.5 | 25 | yes |
| 8 | " | 277 | 100 | " | 9.3 | 550 | 100 | 3.5 | " | 6.5 | 25 | no |
| 9 *5 | AS-Na | 288 | 100 | " | 9.6 | 400 | 100 | 5.5 | " | 6.5 | 30 | yes |
| 10 | " | 288 | 100 | " | 9.3 | 400 | 100 | 3.5 | " | 6.5 | 30 | no |
| 11 *5 | LES-Mg | 421 | 20 | $Mg(OH)_2$ | 16.7 | 550 | 180 | 3 | NaOH | 7 | 25 | yes |
| 12 *5 | " | 421 | 20 | " | 17.2 | 550 | 180 | 6 | " | 7 | 25 | yes |
| 13 *5 | " | 421 | 60 | " | 13.4 | 550 | 140 | 5.5 | " | 7 | 25 | yes |
| 14 | " | 421 | 60 | " | 13.0 | 550 | 140 | 3.5 | " | 7 | 25 | no |
| 15 | " | 421 | 100 | " | 9.4 | 550 | 100 | 3.5 | " | 7 | 25 | no |
| 16 *5 | LES-Na | 432 | 100 | " | 9.6 | 400 | 100 | 6 | TES *6 | 7.5 | 30 | yes |
| 17 | " | 432 | 100 | " | 9.3 | 400 | 100 | 3 | " | 7.5 | 30 | no |
| 18 *5 | LAS-Na | 345 | 20 | $Mg(OH)_2$ | 16.7 | 550 | 180 | 3 | KOH | 5.5 | 25 | yes |
| 19 *5 | " | 345 | 140 | " | 5.7 | 550 | 60 | 5 | " | 5.5 | 25 | yes |
| 20 | " | 345 | 140 | " | 5.6 | 550 | 60 | 3 | " | 5.5 | 25 | no |
| 21 | LES-Mg | 421 | 80 | MgO | 7.7 | 550 | 120 | 3.5 | NaOH | 6 | 25 | no |
| 22 | AOS-Mg | 305 | 60 | " | 8.0 | 350 | 140 | 3.5 | " | 6 | 35 | no |
| 23 | AS-Na | 288 | 60 | " | 8.0 | 400 | 140 | 3.5 | " | 6 | 30 | no |

(Remarks)
*1 AOS-Mg — magnesium salt of α-olefin sulfonic acid,
AOS-Na — sodium salt of α-olefin sulfonic acid,
AS-Mg — magnesium salt of alkyl sulfuric ester,
AS-Na — sodium salt of alkyl sulfuric ester,
LES-Mg — magnesium salt of lauryl ether sulfuric ester ($\bar{p}$ = 3)
LES-Na — sodium salt of lauryl ether sulfuric ester ($\bar{p}$ = 3)
LAS-Na — sodium salt of linear alkylbenzene sulfonic acid.
*2 number-average molecular weight
*3 linear alkylbenzene sulfonic acid
*4 active ingredient concentration
*5 Comparative Example
*6 triethanolamine As is clearly shown in Table 1, in the cases where the addition amount of the LAS is not in stoichiometrical excess to the alkali agent present in the slurry (i.e. Examples 2, 4, 7, 9, 12, 13, 16 and 19) and also in the cases where the addition amount of the LAS is too much in excess to the water-soluble salt of the surface active agent present in the slurry (i.e. Examples 1, 6, 11, 12 and 18), a clear aqueous solution could not obtained. Contrary to this, when the addition amount of the LAS satisfied the above-mentioned two requirements (i) and (ii), a clear aqueous solution having no precipitate was obtained.

What we claim is:

1. A process for producing a clear aqueous solution of the magnesium salt of an anionic surface active agent consisting essentially of the steps of:

(a) adding alkylbenzene sulfonic acid to an aqueous slurry containing a water-soluble anionic surface active agent selected from the group consisting of: (1) the sodium and magnesium salts of olefin sulfonic acids of 8 to 22 carbon atoms, (2) the sodium salts of alkylbenzene sulfonic acids of 10 to 15 carbon atoms, (3) the sodium and magnesium salts of alkyl sulfuric esters having alkyl radicals of 8 to 22 carbon atoms, and (4) the sodium and magnesium salts of alkyl ether sulfuric esters having alkyl radicals of 8 to 22 carbon atoms and having an average addition mole number of ethylene oxide of 1 to 10, and containing at least one alkaline compound selected from the group consisting of magnesium hydroxide and magnesium oxide, to thereby provide a clear aqueous solution having a pH of from approximately 2 to approximately 4, the amount of said alkylbenzene sulfonic acid being (i) sufficient to yield a pH within the range of from approximately 2 to approximately 4, and (ii) to provide a weight ratio of the water-soluble anionic surface active agent in the slurry to the alkylbenzene sulfonic acid within the range of from 20:80 to 95:5, and then:

(b) adding at least one alkaline compound from the group consisting of alkali metal hydroxides, ammonia and triethanolamine to the aqueous solution in a sufficient amount to adjust the pH of the resultant solution within the range of from approximately 5.5 to approximately 8.

2. A process as claimed in claim 1 wherein the addition amount of the alkylbenzene sulfonic acid is within the range of from 1.03 to 1.1 chemical equivalent, based on one chemical equivalent of said alkaline compound in the slurry.

3. A process as claimed in claim 1 wherein said weight ratio of the water-soluble anionic surface active agent to the alkylbenzene sulfonic acid is within the range of from 20:80 to 80:20.

* * * * *